US005474310A

United States Patent [19]

Chen

[11] Patent Number: 5,474,310

[45] Date of Patent: Dec. 12, 1995

[54] IN-LINE SKATES WITH ENHANCED CIRCULAR FLANGES ON THE WHEEL FRAME

[75] Inventor: Ting-Hsing Chen, Tainan, Taiwan

[73] Assignee: Far Great Plastics Industrial Co., Ltd., Tainan, Taiwan

[21] Appl. No.: 340,885

[22] Filed: Nov. 15, 1994

[51] Int. Cl.[6] ..... A63C 17/06

[52] U.S. Cl. ..... 280/11.22; 280/11.27

[58] Field of Search ..... 280/11.22, 11.23, 280/11.27; 301/5.3, 5.7

[56] References Cited

U.S. PATENT DOCUMENTS

| | | | |
|---|---|---|---|
| 3,963,252 | 6/1976 | Carlson | 280/11.22 |
| 5,046,746 | 9/1991 | Gierveld | 280/11.22 |
| 5,068,956 | 12/1991 | Malewicz | 280/11.27 X |
| 5,129,663 | 7/1992 | Soo | 280/11.22 X |
| 5,190,301 | 3/1993 | Malewicz | 280/11.22 |

*Primary Examiner*—Brian L. Johnson

*Attorney, Agent, or Firm*—Morton J. Rosenberg; David I. Klein

[57] ABSTRACT

A tandem skate which has circular flanges formed on respective sides of each axle aperture to receive each bolt head and each nut therein. The flanges absorb the push off force applied against a riding surface to accelerate the speed of skating, and the restraint force. The flanges also prevent the deforming, and deviation of axle aperture, so as to increase the life of the tandem skate.

1 Claim, 3 Drawing Sheets

IN-LINE SKATES WITH ENHANCED CIRCULAR FLANGES ON THE WHEEL FRAME

BACKGROUND OF THE INVENTION

1. Field of the Invention

This invention relates to tandem skates and more particularly to tandem skates having circular flanges at the outer peripheries of the axle apertures, to absorb push off forces.

2. Prior Art

In-line skates or tandem skates of the prior art utilize two or more wheels positioned one in front of another within a wheel frame. The wheel frame is usually formed as a channel, like an inverted capital letter "U", the wheels being secured by bolts and nuts therein, as shown in FIG. 3.

A bolt 2 is inserted into an axle aperture 11 from one side and extending outwardly from the other side and fastened by a nut 21 at the other side to secure the wheel 3 to the wheel frame 1. The head of the bolt 2 and the nut 21 are both exposed outside of lugs 12 which are formed integrally to the respective sides of the axle aperture 11.

Most of the forces from skating are transferred to the wheel frame 1 through the bolt 2 at two specific points A and B. These forces will subsequently cause the wheel frame 1 to deform and increase the tolerance between the axle aperture 11 and the bolt 2.

SUMMARY OF THE INVENTION

It is the primary object of the present invention to provide a tandem skate with enhanced circular flanges on a wheel frame. The wheel frame is provided with circular flanges on respective sides thereof, around each axle aperture for dispersing the push off force or jumping force so as to protect the axle aperture from deforming.

It is another object of the present invention to provide a tandem skate with enhanced circular flanges on a wheel frame on which it is easy to install and easy to replace the wheels.

It is a further object of the present invention to provide a tandem skate with enhanced circular flanges on a wheel frame which is inexpensive to produce.

DETAILED DESCRIPTION OF THE PREFERRED EMBODIMENT

Figure 1:
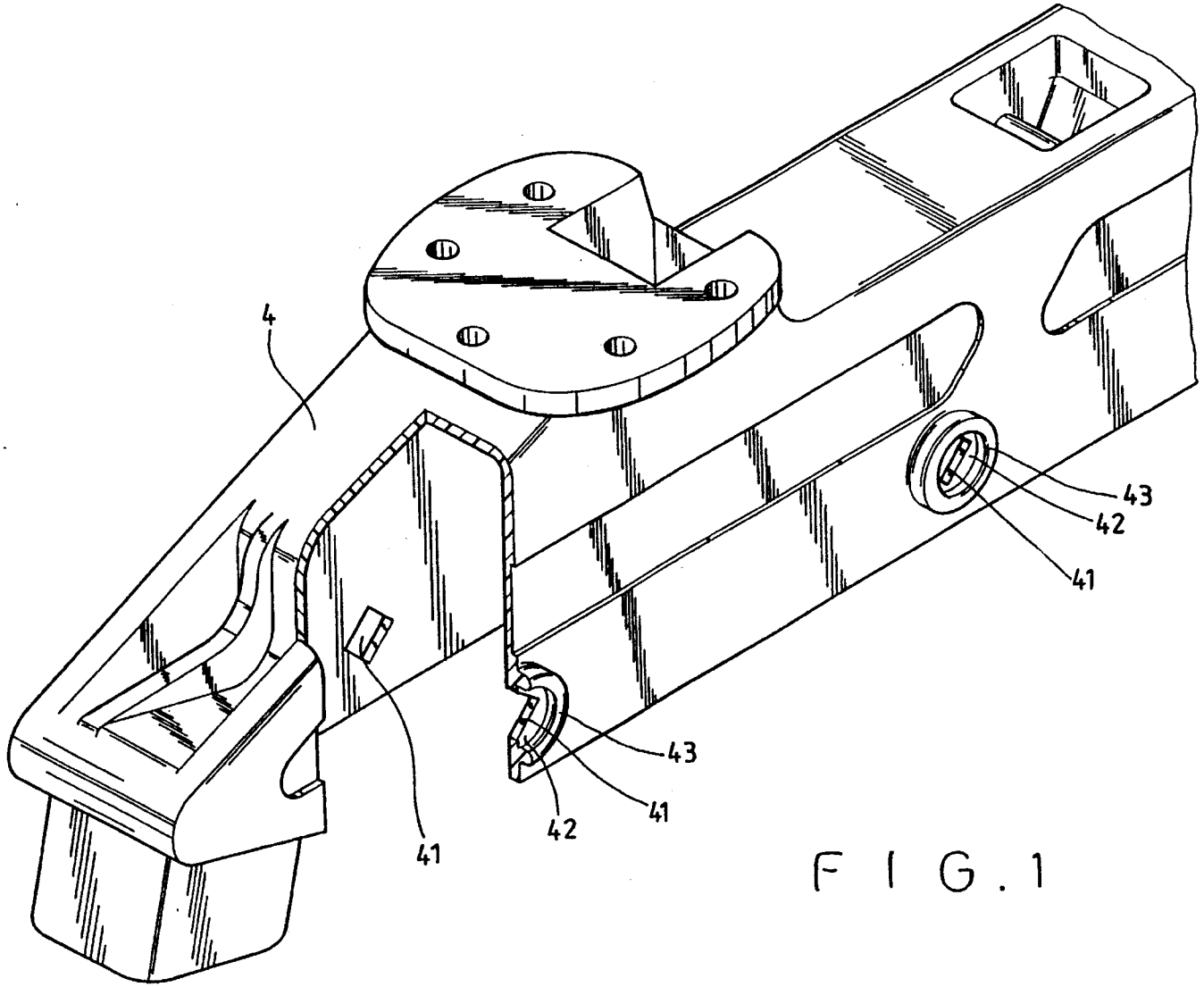
FIG. 1 is a perspective view, partially sectioned, of a wheel frame incorporating the present invention.
Figure 2:
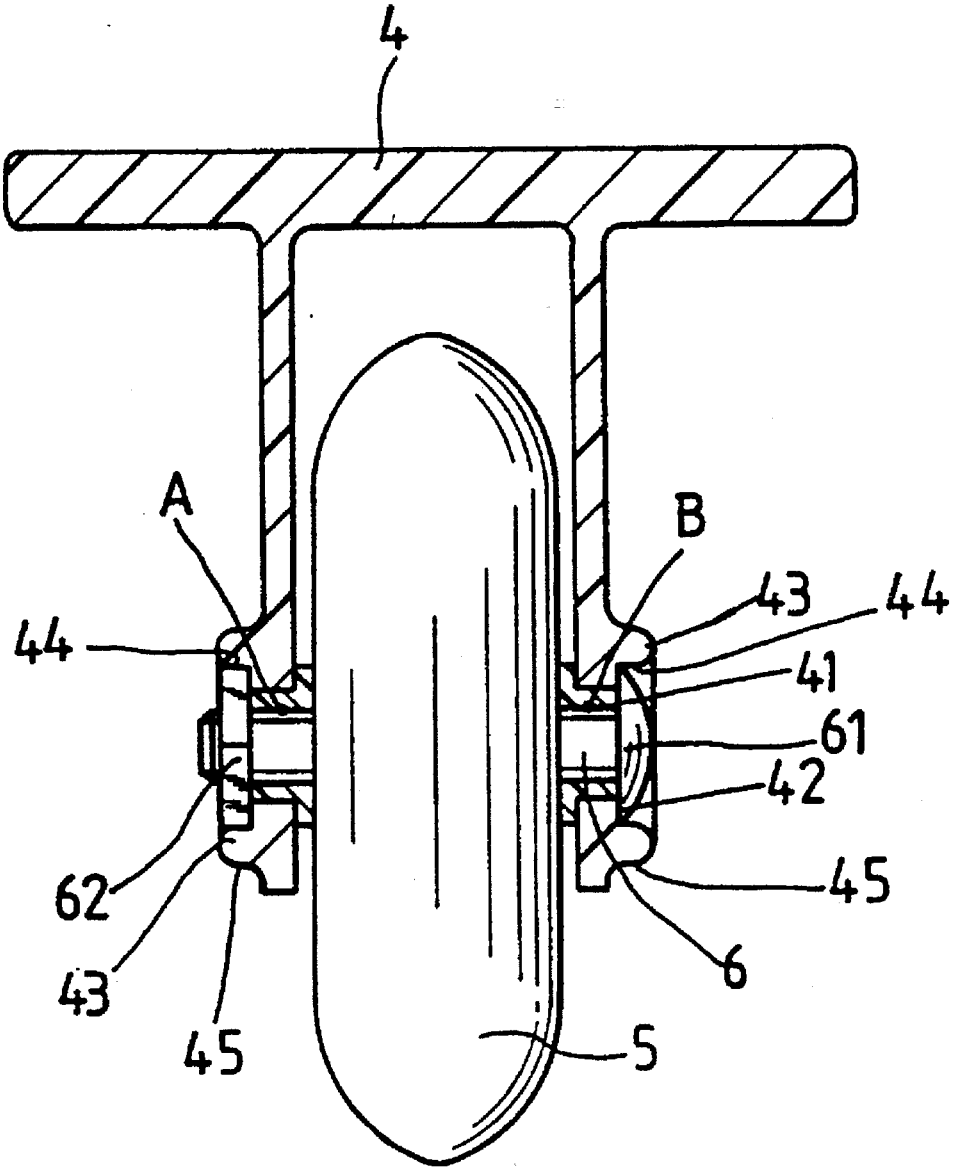
FIG. 2 is a partially sections elevation view of the present invention; and, FIG. 3 is a partially sectioned elevation view of a prior art assembly.
Figure 3:
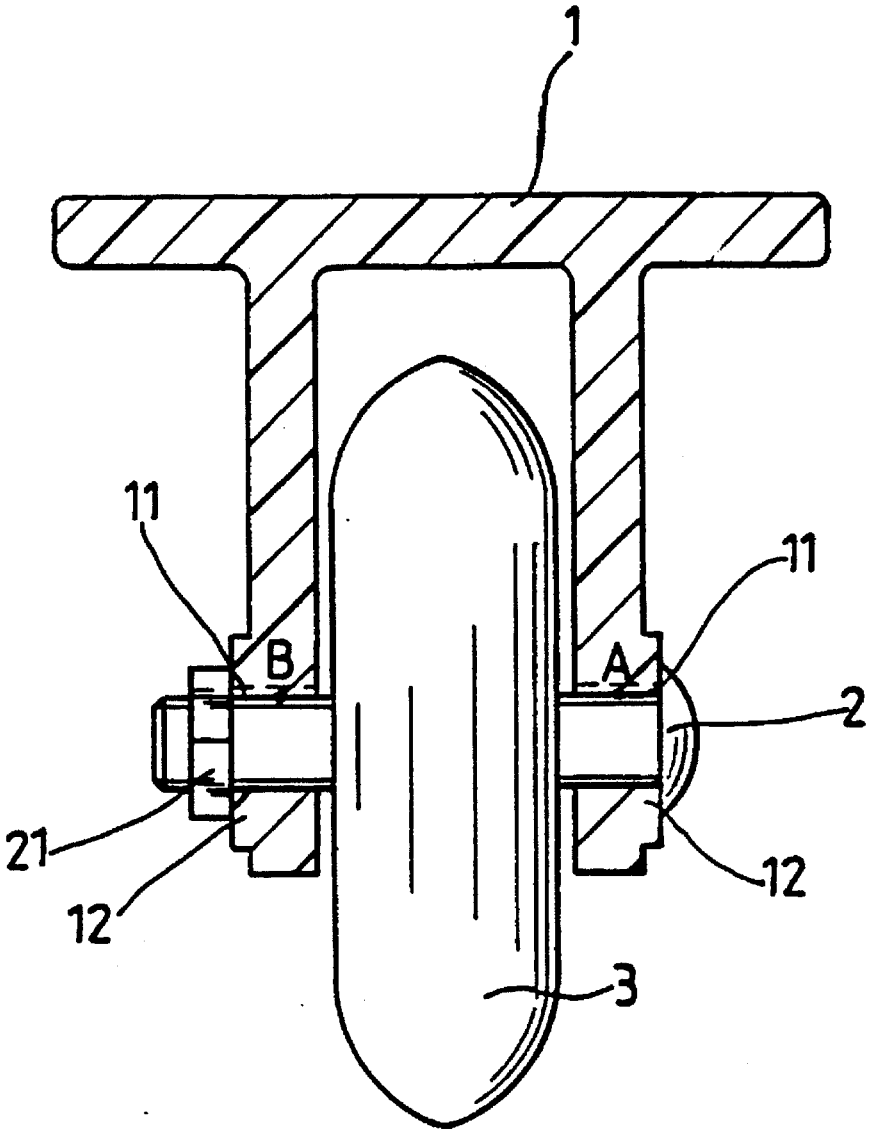
FIG. 3 (PRIOR ART)

Referring now to FIGS. 1 and 2, there are shown circular flanges which are integrally formed on the periphery of the wheel frame for the purpose of illustrating the preferred embodiment and not for the purpose of limiting the inventive concept illustrated therein. FIG. 1 shows a wheel frame

4 for mounting wheels 5, having lugs 42 integrally formed at the respective outsides thereof which include circular flanges 43 each comprising inner surface 44 and outer surface 45, and integrally formed so as to surround and encircle the respective outsides of the lugs 42. The circular flanges are formed such that a bolt 6 may be inserted into the axle aperture 41 from one side and secured by a nut 62 at the other side of the axle aperture 41. Both the head 61 of the bolt 6 and the nut 62 will be embedded in the circular flanges 43 and in contact with inner surfaces 44, as shown in FIG. 2. Therefore, responsive to a pushing off force being applied against a riding surface, the circular flanges 43 along with the two specific points A and B, as shown in FIG. 2, share the load. Together, the shaft 6 and flanges 43 can withstand the riding strain forces encountered under normal and adverse conditions.

I claim:

1. A tandem skate wheel assembly, comprising:

a channel shaped wheel frame having a pair of opposing side walls, one of said pair of side walls having a plurality of lug portions formed therein and a respective plurality of first axle apertures formed through said lug portions, the other of said pair of side walls having a plurality of lug portions formed therein and a respective plurality of second axle apertures formed through said lug portions, said plurality of first axle apertures being disposed in respective corresponding relationship with said plurality of second axle apertures, said wheel frame having an integrally formed annular flange surrounding and encircling each said plurality of first and second axle apertures;

a plurality of wheels disposed between said pair of wheel frame side walls, each of said wheels having a through bore disposed in axial alignment with a respective pair of opposing first and second axle apertures of said wheel frame;

a plurality of axle bolts, each of said plurality of axle bolts having a head portion formed on one end, a threaded portion formed on an opposing end thereof and a shaft portion therebetween, each of said axle bolts passing through a respective pair of opposing first and second axle apertures and a respective one of said wheel through bores, said head portion of each of said plurality of axle bolts being disposed in contiguous contact with an inner surface of a respective one of said plurality of annular flanges of a respective side wall for transferring a portion of a loading force thereto; and, a plurality of nuts, each of said plurality of nuts being threadedly engaged with a threaded portion of a respective one of said plurality of axle bolts, each said nut being disposed in contiguous contact with an inner surface of a respective one of said plurality of annular flanges of a respective side wall for transferring a portion of said loading force thereto, whereby a loading force applied to each wheel is divided between a respective pair of said opposing first and second axle apertures and said annular flanges surrounding said first and second axle apertures.

* * * * *